US010366820B2

(12) United States Patent
Ishizaki

(10) Patent No.: US 10,366,820 B2
(45) Date of Patent: Jul. 30, 2019

(54) THIN FILM INDUCTOR

(71) Applicant: TDK CORPORATION, Tokyo (JP)

(72) Inventor: Kazuo Ishizaki, Tokyo (JP)

(73) Assignee: TDK CORPORATION, Tokyo (JP)

( * ) Notice: Subject to any disclaimer, the term of this patent is extended or adjusted under 35 U.S.C. 154(b) by 0 days.

(21) Appl. No.: 15/467,278

(22) Filed: Mar. 23, 2017

(65) Prior Publication Data

US 2017/0287622 A1 Oct. 5, 2017

(30) Foreign Application Priority Data

Mar. 30, 2016 (JP) ..... 2016-068789

(51) Int. Cl.

| | |
|---|---|
| ***H01F 27/28*** | (2006.01) |
| ***H01F 27/32*** | (2006.01) |
| ***H01F 41/04*** | (2006.01) |
| ***H01F 17/00*** | (2006.01) |
| *H01F 17/04* | (2006.01) |

(52) U.S. Cl.

CPC ..... *H01F 27/2804* (2013.01); *H01F 17/0013* (2013.01); *H01F 27/323* (2013.01); *H01F 41/042* (2013.01); *H01F 41/046* (2013.01); *H01F 2017/048* (2013.01); *H01F 2027/2809* (2013.01)

(58) Field of Classification Search

CPC .. H01F 27/2804; H01F 27/323; H01F 41/042; H01F 2027/2809

USPC ..... 336/200, 232

See application file for complete search history.

(56) References Cited

U.S. PATENT DOCUMENTS

| | | | | |
|---|---|---|---|---|
| 2012/0126928 | A1* | 5/2012 | Yoshikawa | H01F 27/306 336/221 |
| 2013/0293338 | A1* | 11/2013 | Park | H01F 27/343 336/200 |
| 2015/0048918 | A1 | 2/2015 | Park et al. | |
| 2015/0097647 | A1* | 4/2015 | Lee | H01F 17/0013 336/192 |
| 2016/0086722 | A1* | 3/2016 | Sim | H01F 17/0013 336/192 |

FOREIGN PATENT DOCUMENTS

| | | |
|---|---|---|
| JP | 2015-037189 A | 2/2015 |

* cited by examiner

*Primary Examiner* — Tszfung J Chan
(74) *Attorney, Agent, or Firm* — Oliff PLC

(57) ABSTRACT

A thin film inductor 1 includes: a coil part that is formed of at least one coil conductor layer and has terminal electrodes provided at both ends thereof; a first insulating layer that covers the coil part; and a second insulating layer that covers the first insulating layer and has a higher Young's modulus than the first insulating layer.

3 Claims, 7 Drawing Sheets

34
33
32
31

35
34
33
32
31

35
34
33
32
31
36

34
37
36

34
37
36
37a 37
38

34
39
38
37
36
40
41
41a
42

34
37
41
36
40
42
43
44
45

THIN FILM INDUCTOR

TECHNICAL FIELD

The present invention relates to a thin film inductor.

BACKGROUND

As electronic products, such as communication terminals, are reduced in size, a reduction in size including a reduction in height is also required for electronic components used for the electronic products. This is also true of inductors. A study has been made of thin film inductors (for example, see Japanese Unexamined Patent Publication No. 2015-37189).

SUMMARY

However, an attempt to make thin film inductors thinner has a problem in that deformation or breakage easily occurs during handling of the thin film inductors.

The present invention was made in terms of the foregoing, and an object thereof is to provide a thin film inductor that is further improved in rigidity while characteristics thereof are maintained.

To achieve the object, a thin film inductor according to an aspect of the present invention includes: a coil part formed of at least one coil conductor layer and having terminal electrodes provided at both ends thereof; a first insulating layer configured to cover the coil part; and a second insulating layer configured to cover the first insulating layer and having a higher Young's modulus than the first insulating layer.

In the thin film inductor, since the first insulating layer which has a low Young's modulus covers surroundings of the coil part the first insulating layer absorbs stress when any force is received from the outside so that deformation of the coil part can be prevented and a drop in characteristics of an inductor can be prevented. In addition, the second insulating layer which has a high Young's modulus is configured to cover the first insulating layer to enhance rigidity of the entire thin film inductor and improve handleability.

Here, the second insulating layer may use a composite material of a ceramic or a resin and a metal material as a main component.

As described above, the composite material of a ceramic or a resin and a metal material is used as the main component of the second insulating layer so that performance of the thin film inductor can be improved while rigidity is enhanced.

The metal material may be nickel, iron, aluminum, or copper. Nickel, iron, aluminum, or copper is used as the metal material so that a thin film inductor whose rigidity is further enhanced while a cost thereof is suppressed and characteristics thereof are maintained can be manufactured.

According to the present invention, a thin film inductor that is further improved in rigidity while characteristics thereof are maintained is provided.

DETAILED DESCRIPTION

Hereinafter, an embodiment for carrying out the present invention will be described with reference to the attached drawings. Note that, in the description of the drawings, the same elements are given the same reference signs, and duplicate description thereof will be omitted.

Figure 1:
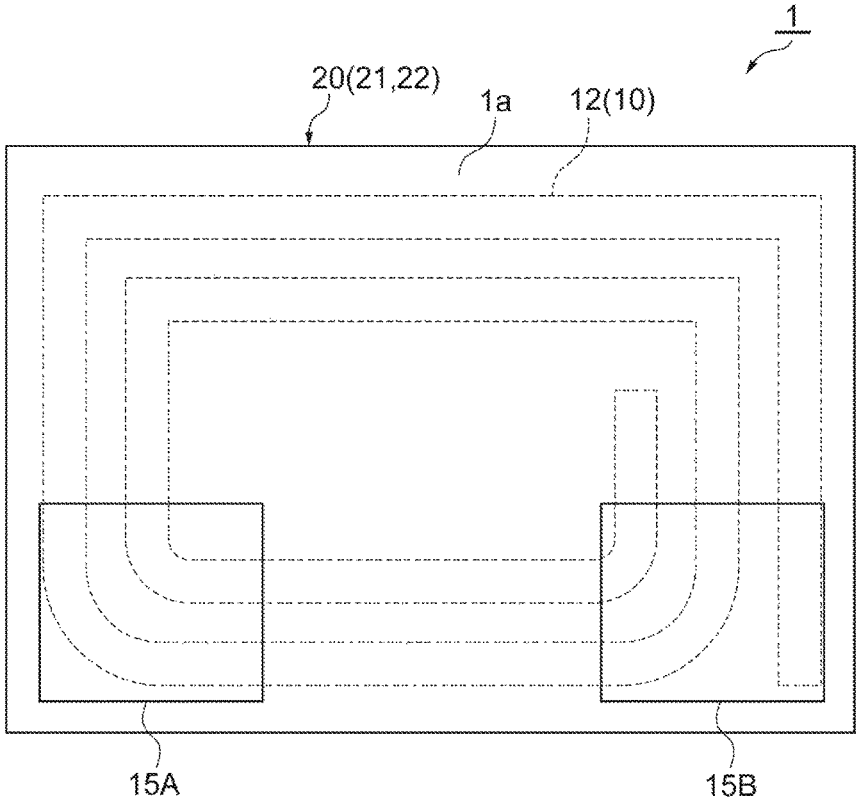
FIG. 1 is a top view of a thin film inductor according to an embodiment of the present invention.
Figure 2:
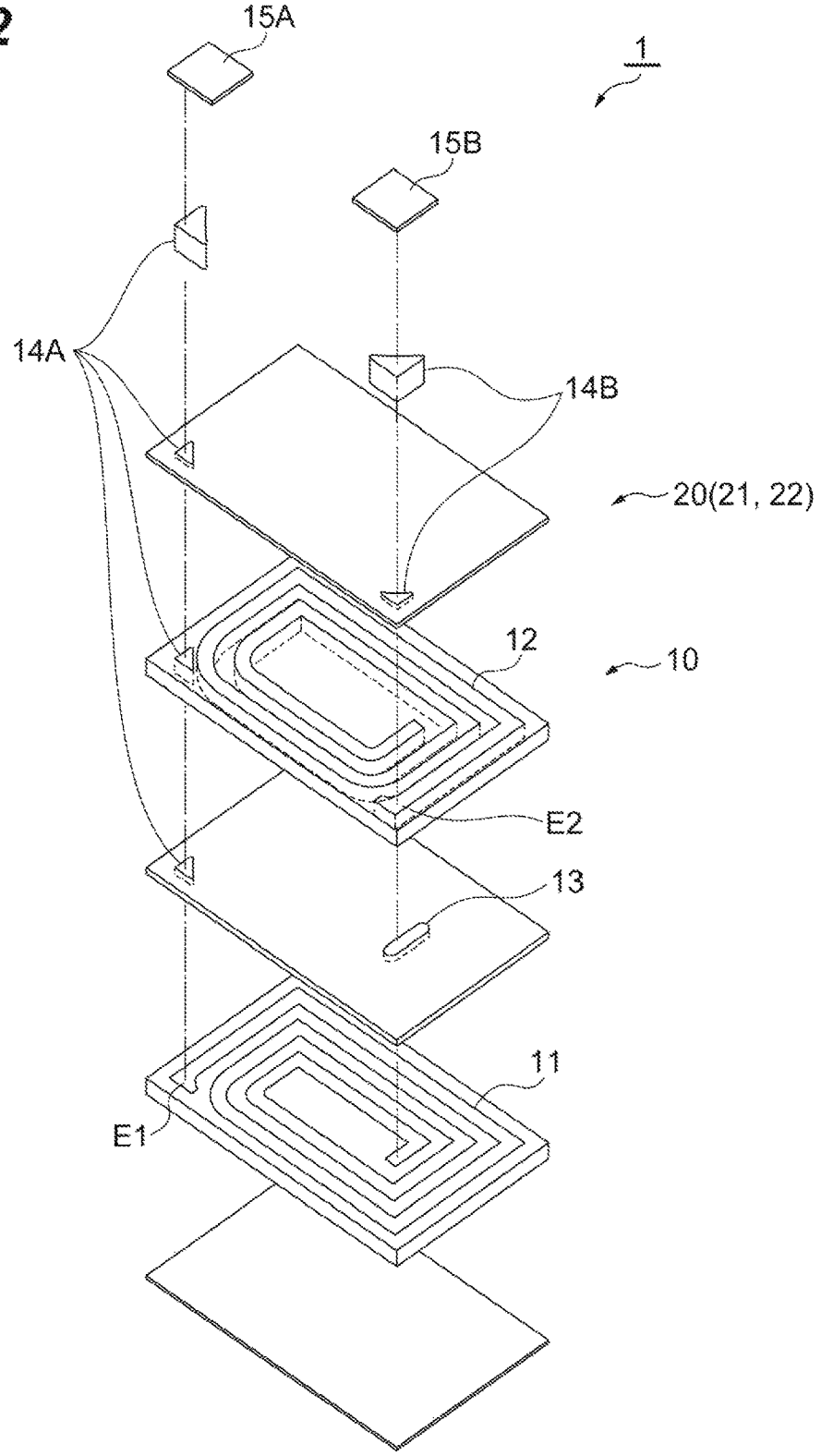
FIG. 2 is an exploded perspective view of the thin film inductor.
Figure 3:
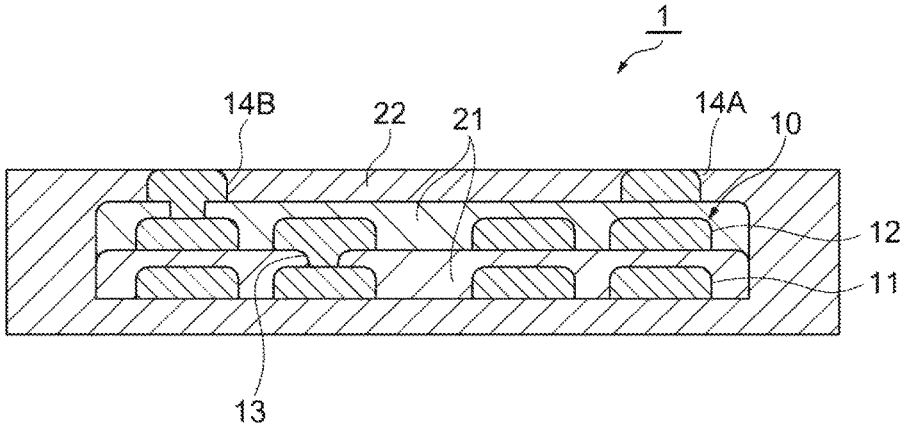
FIG. 3 is a sectional view schematically illustrating an internal structure of the thin film inductor.

A schematic configuration of a thin film inductor according to an embodiment of the present invention will be described with reference to FIGS. 1 to 3. FIG. 1 is a top view of the thin film inductor according to the present embodiment. FIG. 2 is an exploded perspective view of the thin film inductor. FIG. 3 is a sectional view schematically illustrating an internal structure of the thin film inductor.

As illustrated in FIGS. 1 to 3, a thin film inductor 1 is a thin film in which a coil part 10 (to be described below) is provided. Although details will be described below, the coil part 10 is doubly covered by a first insulating layer 21 and a second insulating layer 22. In a top view, the thin film inductor 1 has an approximately rectangular shape with a short side of about 0.2 mm to 0.7 mm and a long side of about 0.8 mm to 1.2 mm and has a thickness of about 30 μm to 500 μm. The shape in the top view is not particularly limited.

The coil part 10 is formed of a metal material having conductivity such as copper (Cu), and an axis thereof extends in a direction orthogonal to a main surface 1*a* thereof. The coil part 10 has two coil conductor layers, and is provided with first and second coil layers 11 and 12 that act as the coil conductor layers, a connector 13 connecting the first and second coil layers 11 and 12, and lead-out conductors 14A and 14B.

The first coil layer 11 and the second coil layer 12 are arranged in the direction orthogonal to the main surface 1*a* (in the direction of the axis of the coil part). The second coil layer 12 is located closer to the main surface 1*a* than the first coil layer 11. The first coil layer 11 and the second coil layer 12 have the same winding direction. The connector 13 is interposed between the first coil layer 11 and the second coil layer 12 and connects an inner end of the first coil layer 11 and an inner end of the second coil layer 12. A case in which each of the first coil layer 11 and the second coil layer 12 is a coil having a plurality of turns will be described, but the number of turns in the coil layers is not limited.

The lead-out conductors 14A and 14B respectively form ends of the coil part 10. The lead-out conductor 14A extends from an outer end E1 of the first coil layer 11 in the direction orthogonal to the main surface 1*a*. The lead-out conductor 14B extends from an outer end E2 of the second coil layer 12 in the direction orthogonal to the main surface 1*a*.

Ends of the lead-out conductors 14A and 14B, namely opposite ends of the coil part 10, are connected to terminal electrodes 15A and 15B provided on the main surface 1*a* of the thin film inductor 1. The terminal electrodes 15A and 15B are connected to the ends of the internal coil part 10. Both of the terminal electrodes 15A and 15B are film shaped and have an approximately square shape in the top view. The terminal electrodes 15A and 15B are formed of a conductive material such as Cu.

Each of the first coil layer 11 and the second coil layer 12 has a thickness of about 30 μm to 80 μm, and the coil part 10 has an overall thickness of about 70 μm to 180 μm.

The coil part 10 is covered by an insulating layer 20 including the first insulating layer 21 and the second insulating layer 22.

The insulating layer 20 including the first insulating layer 21 and the second insulating layer 22 integrally covers the first coil layer 11, the second coil layer 12, the connector 13, and the lead-out conductors 14A and 14B of the coil part 10, prevents the parts of the coil part 10 from coining into contact with each other, and suppresses misalignment. As illustrated in FIG. 3, the insulating layer 20 has a dual structure of the first insulating layer 21 and the second insulating layer 22. That is, the coil part 10 is covered by the first insulating layer 21, and the first insulating layer 21 is covered by the second insulating layer 22. The entire surface of the coil part 10 need not be covered by the first insulating layer 21, and the entire surface of the first insulating layer 21 need not be covered by the second insulating layer 22. However, the entire surface of the coil part 10 is covered by any one of the first insulating layer 21 and the second insulating layer 22 excepting the ends connected to the terminal electrodes 15A and 15B. As a result, except for regions around the terminal electrodes 15A and 15B, the first insulating layer 21 or the second insulating layer 22 is exposed to the outside on a surface of the thin film inductor 1.

In the thin film inductor 1 according to the present embodiment, as illustrated in FIG. 3, the first coil layer 11, the second coil layer 12, and the connector 13 of the coil part 10 are covered by the first insulating layer 21 excepting a lower surface of the first coil layer 11 (a surface opposite to the second coil layer 12 side). The lower surface of the first coil layer 11, the surroundings of the lead-out conductors 14A and 14B, and an outer side of the first insulating layer 21 are covered by the second insulating layer 22.

The first insulating layer 21 and the second insulating layer 22 are formed of an insulating material as a main component. "Main component" refers to a proportion greater than or equal to 50 mass % being occupied by a corresponding component. Main components of the first and second insulating layers 21 and 22 can be used by appropriately selection from materials such as: a resin of polystyrene, polyethylene, polyimide, polyethylene terephthalate (PET), epoxy, or the like; $SiO_2$; SiN; $Al_2O_3$; or the like.

The second insulating layer 22 may further contain a magnetic material. The magnetic material includes, for instance, soft ferrite, permalloy, sendust, silicon steel, and pure iron. In addition, a content of the magnetic material can be set to a range from 30 vol % to 90 vol %, and preferably from 50 vol % to 90 vol %. The magnetic material can also be included in the first insulating layer 21. In this case, the magnetic material can be selected to be the same material as the magnetic material in the second insulating layer 22. A content of the magnetic material in the first insulating layer 21 is made smaller than that in the second insulating layer 22, and thereby an effect on mechanical strength of the present invention can be exerted while magnetic characteristics thereof are adjusted.

The second insulating layer 22 can use a composite material of a ceramic or a resin and a metal material as the main component. The metal material is not particularly limited. However, from the viewpoint of cost or conductivity, nickel, iron, aluminum, or copper can be used. When the composite material is used as the main component, a content of the metal material in the composite material can be set to a range from 30% to 90%. Various methods such as a method of mixing a powder of the metal material into a ceramic or a resin, a mode of forming a thin film of the metal material on a surface of a ceramic or a resin, and so on can be selected as a method of forming the composite material of the metal material. Since the second insulating layer 22 uses the above composite material as the main component, performance of the thin film inductor 1 can be improved while rigidity of the insulating layer 20 is enhanced.

Materials used for the main components of the first and second insulating layers 21 and 22 are selected such that Young's modulus of the second insulating layer 22 is higher than that of the first insulating layer 21. Therefore, when the insulating materials exemplified above are selected as the main components of the first and second insulating layers 21 and 22, a combination thereof is limited.

Young's moduli of insulating materials that are conceivably usable as the first and second insulating layers 21 and 22 of the thin film inductor 1 according to the present embodiment due to having insulation property are shown by way of example in Table 1.

TABLE 1

| Material | Young's modulus [Gpa] Room temperature to 300° C. |
|---|---|
| SiN | 290 |
| $Al_2O_3$ | 370 |
| AlN | 320 |
| GaAs | 83 |
| SiC | 430 |
| $ZrO_2$ | 200 |
| glass | 80 |
| $SiO_2$ | 72 |
| polyethylene | 0.7 |
| polystyrene | 3.2 |
| polyimide | 3 to 7 |
| PET | 2.7 |
| epoxy | 2.6 to 3 |

As described above, the Young's moduli of the insulating materials that can be selected as the main components of the first and second insulating layers 21 and 22 are significantly different from one another according to material. Therefore, when the main components of the first and second insulating layers 21 and 22 are selected, they can be selected, for instance, according to a combination shown in Table 2 below such that the Young's modulus of the second insulating layer 22 is higher than that of the first insulating layer 21. The combinations below are examples, and can be appropriately changed.

TABLE 2

| first insulating layer | second insulating layer |
|---|---|
| polyethylene | polystyrene |
| polyethylene | polyimide |
| polyethylene | PET |
| polyethylene | epoxy |
| polystyrene | polyimide |
| PET | polyimide |
| PET | epoxy |
| PET | polystyrene |
| epoxy | polystyrene |
| epoxy | polyimide |
| polyethylene | $SiO_2$ |
| polystyrene | $SiO_2$ |

TABLE 2-continued

| first insulating layer | second insulating layer |
|---|---|
| PET | $SiO_2$ |
| epoxy | $SiO_2$ |
| $SiO_2$ | SiN |
| $SiO_2$ | $Al_2O_3$ |

The main components of the first and second insulating layers 21 and 22 are selected such that the Young's modulus of the second insulating layer 22 is higher than that of the first insulating layer 21. Thereby, the thin film inductor 1 whose rigidity is enhanced while characteristics thereof are maintained can be obtained.

Since conventional thin film inductors are extremely thin, there is a problem with handleability thereof. There is room for improvement from the viewpoint of restorability against deformation that can be caused by a mounting operation or the like. That is, when the coil part inside the thin film inductor is deformed by the mounting operation or the like and is mounted in that state, there is a possibility of a drop in performance occurring with misalignment or the like of the coil part.

In contrast, in the thin film inductor 1 according to the present embodiment, since the first insulating layer 21 which has a low Young's modulus covers the surroundings of the coil part 10, the first insulating layer 21 absorbs stress when any force is received from the outside so that deformation of the coil part 10 can be prevented and a drop in characteristics of the inductor can be prevented.

A proportion covered by the first insulating layer 21 in relation to a surface area of the coil part 10 preferably ranges from 60% to 100%. However, in this case, areas of junction portions with the lead-out conductors 14A and 14B and areas of junction portions of the connector 13 with the first and second coil layers 11 and 12 are not included in the surface area of the coil part 10. As the proportion covered by the first insulating layer 21 ranges from 60% to 100%, misalignment or the like can be favorably prevented while damage to the coil part 10 of the thin film inductor 1 is prevented. A proportion covered by the second insulating layer 22 in relation to a surface area of a complex made up of the first insulating layer 21 and the coil part 10 preferably ranges from 85% to 100%. As the proportion covered by the second insulating layer 22 ranges from 85% to 100%, rigidity of the entire thin film inductor 1 is favorably enhanced.

In the complex of the first insulating layer 21 and the coil part 10, when the coil part 10 is exposed to the outside of the first insulating layer 21, since an exposed area of the coil part 10 is preferably suppressed to a range from 5% to 20% in relation to the surface area of the complex. Thereby, an external force can be suitably inhibited from being applied to the coil part 10.

The first insulating layer 21 preferably exists between the first coil layer 11 and the second coil layer 12. Since a thickness of the first insulating layer 21 at this portion preferably ranges from 0.5 times to 1.0 time the thickness of any one of the first coil layer 11 and the second coil layer 12. Thereby, an external force transmitted to one of the coil layers can be suitably inhibited from being propagated to the other coil layer.

The first insulating layer 21 preferably exists between lines of the first coil layer 11 and between lines of the second coil layer 12. A width of the first insulating layer 21 at this portion preferably ranges from 0.5 times to 1.0 time a line width of the first coil layer 11 or a line width of the second coil layer 12. Thereby, an external force transmitted to the first coil layer 11 or the second coil layer 12 can be suitably inhibited from being propagated inside the coil layer to deform the coil layer.

Next, a method of manufacturing the thin film inductor 1 will be described with reference to FIGS. 4A to 7E. In FIGS. 4A to 6E, a manufacturing procedure of one thin film inductor will be described. However, in practice, as illustrated in FIGS. 7A to 7E, a plurality of thin film inductors are formed on one wafer and are then divided into individual pieces. In FIGS. 4A to 6E, a specific portion (a portion equivalent to an individual piece acting as a thin film inductor) on one wafer is enlarged and shown.

As described above, the thin film inductor 1 has two coil layers and lead-out conductors. Therefore, a process of forming the conductor layers is repeated three times.

Figures 4A, 4B, 4C, 4D, 4E, 4F:
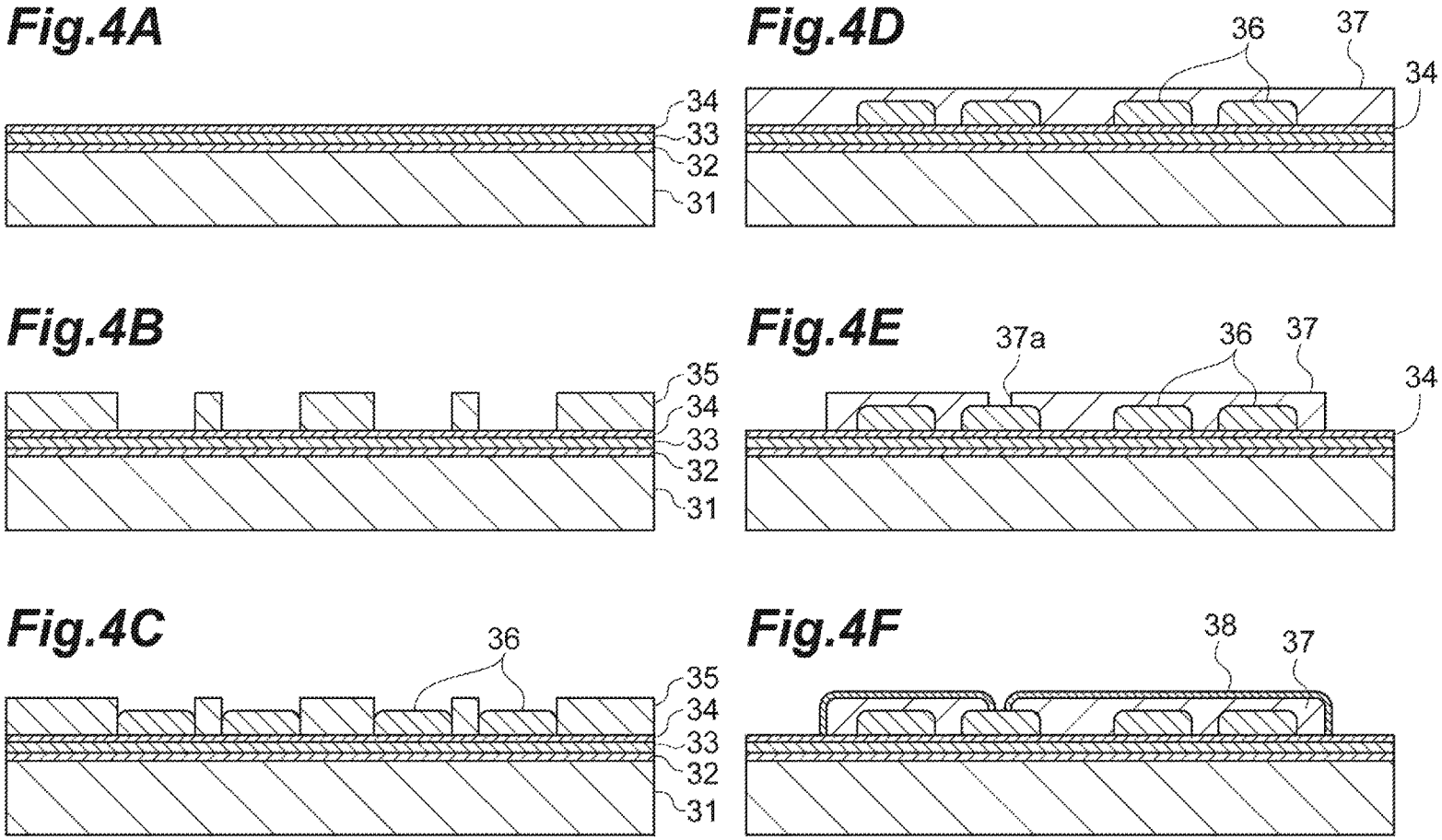
FIGS. 4A, 4B, 4C, 4D, 4E and 4F are sectional views illustrating a method of manufacturing the thin film inductor.

First, as illustrated in FIG. 4A, a base material in which a copper foil with a carrier is laminated on a wafer 31 of Si or the like via an adhesive layer 32 is prepared. The copper foil with a carrier refers to a carrier foil 33 and a copper foil 34 being adhered via a release layer and then being laminated such that the carrier foil 33 is arranged toward the adhesive layer 32. Subsequently, resist pre-processing is performed.

Next, after a resist is formed on a surface of the copper foil 34 of the base material, an active light (UV light or the like) is applied through a photomask, and portions exposed to the active light are cured. Subsequently, the resist other than the cured portions is removed, and thereby a resist pattern 35 is formed as illustrated in FIG. 4B.

Next, as illustrated in FIG. 4C, a plating layer (a plating pattern) 36 is formed on the copper foil 34 on which the resist pattern 35 is formed. A method of forming the plating layer 36 can use a well-known method. The plating layer 36 becomes the first coil layer 11.

Subsequently, the resist pattern 35 is removed. Then, as illustrated in FIG. 4D, a first insulating material layer 37 is laminated on surfaces of the plating layer 36 and the copper foil 34 with the insulating material used for the first insulating layer 21. Subsequently, as illustrated in FIG. 4E, the insulating material other than the insulating material at a region that becomes the first insulating layer 21 is removed by curing or patterning using a photomask. On this occasion, an opening 37*a* is formed in a portion corresponding to the connector 13. Thereby, portions corresponding to the first coil layer 11 and the first insulating layer 21 of the periphery of the first coil layer 11 are formed.

Next, as illustrated in FIG. 4F, a sheet layer 38 is formed on a surface of the first insulating material layer 37 by sputtering. Subsequently, portions corresponding to the second coil layer 12 and the first insulating layer 21 of the periphery of the second coil layer 12 are formed, and a series of processes up to this point is repeated.

That is, after the resist is formed on surfaces of the copper foil 34 and the sheet layer 38, the active light (the UV light or the like) is applied through a photomask, and portions exposed to the active light are cured. Subsequently, cured portions other than the resist are removed, and thereby a resist pattern 39 is formed as illustrated in FIG. 5A.

Figures 5A, 5B, 5C, 5D, 5E:
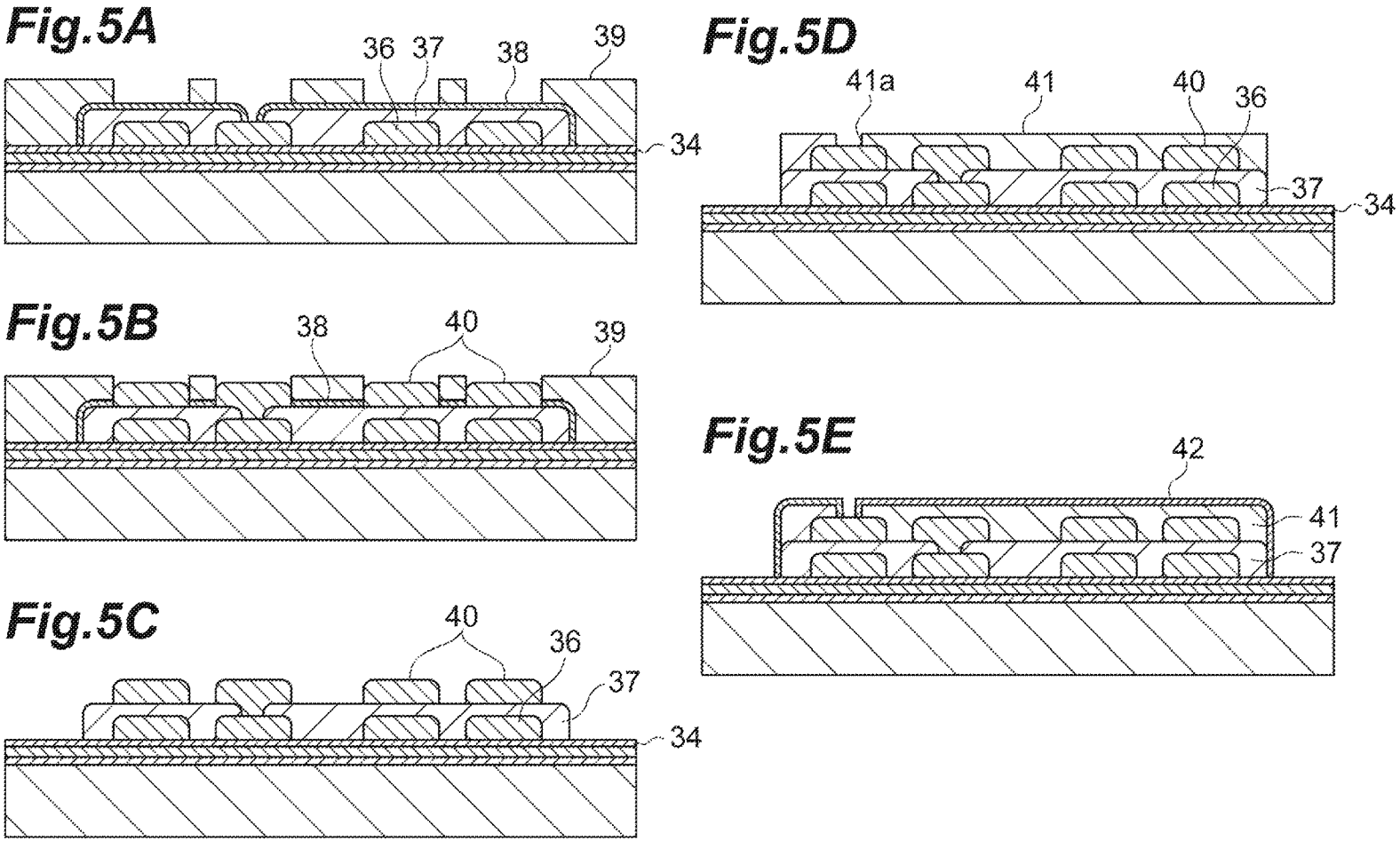
FIGS. 5A, 5B, 5C, 5D, and 5E are sectional views illustrating the method of manufacturing the thin film inductor.

Next, as illustrated in FIG. 5B, a plating layer (a plating pattern) 40 is formed on the sheet layer 38 on which the resist pattern 39 is formed. The plating layer 40 becomes the second coil layer 12.

Subsequently, the resist pattern 39 is removed and the remaining sheet layer 38 is further removed. Thereby, as illustrated in FIG. 5C, the plating layer 40 becomes the second coil layer 12 and is exposed. Subsequently, a second insulating material layer 41 is laminated on surfaces of the first insulating material layer 37, the plating layer 40, and the copper foil 34 using the insulating material used for the first insulating layer 21 and is partially removed by curing and patterning using a photomask. Thereby, as illustrated in FIG. 5D, the insulating material other than the insulating material at the region that becomes the first insulating layer 21 is removed. On this occasion, openings 41*a* are formed in portions corresponding to the lead-out conductors 14A and 14B. Thereby, portions corresponding to the second coil layer 12 and the first insulating layer 21 of the periphery of the second coil layer 12 are formed. In addition, a portion corresponding to the connector 13 is formed.

Next, as illustrated in FIG. 5E, a sheet layer 42 is formed on surfaces of the first and second insulating material layers 37 and 41 by sputtering. Subsequently, portions corresponding to the lead-out conductors and a portion corresponding to the second insulating layer 22 are formed.

That is, after the resist is formed on surfaces of the copper foil 34 and the sheet layer 42, the active light (the UV light or the like) is applied through a photomask, and portions exposed to the active light are cured. Subsequently, cured portions other than the resist are removed, and thereby a resist pattern 43 is formed as illustrated in FIG. 6A.

Figures 6A, 6B, 6C, 6D, 6E:
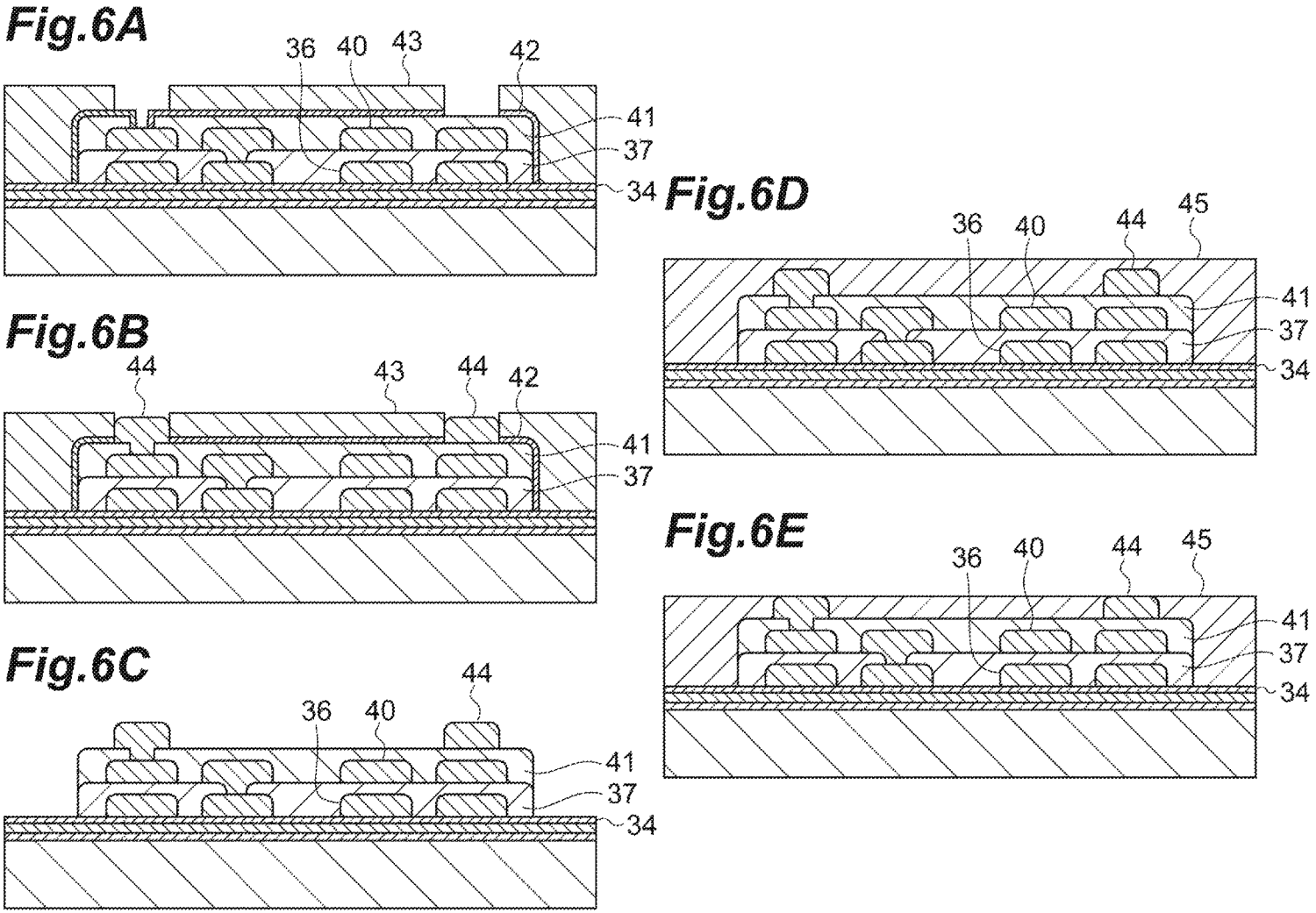
FIGS. 6A, 6B, 6C, 6D, and 6E are sectional views illustrating the method of manufacturing the thin film inductor.

Next, as illustrated in FIG. 6B, plating layers (plating patterns) 44 are formed on the sheet layer 38 on which the resist pattern 43 is formed. The plating layers 44 become the lead-out conductors 14A and 14B.

Subsequently, the resist pattern 43 is removed, and the remaining sheet layer 42 is further removed. Thereby, as illustrated in FIG. 6C, the plating layers 44 that become the lead-out conductors 14A and 14B are exposed. Next, as illustrated in FIG. 6D, a third insulating material layer 45 is laminated by a magnetic mold using the insulating material used for the second insulating layer 22. Subsequently, surface polishing is performed. Thereby, as illustrated in FIG. 6E, a laminate in which the surroundings of the first and second coil layers 11 and 12 are doubly covered by the first and second insulating layers 21 and 22 is obtained. In this step, the thin film inductor is in a state in which key parts thereof are laminated on the wafer 31 and in which division into individual pieces acting as the thin film inductor is not performed. The method of manufacturing the thin film inductor 1 acting as an individual piece will be described with reference to FIG. 7.

Figure 7A:
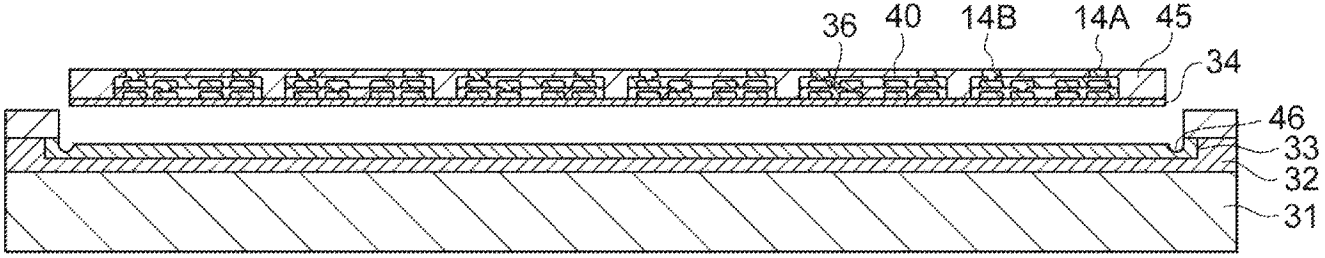
FIGS. 7A, 7B, 7C, 7D, and 7E are sectional views illustrating the method of manufacturing the thin film inductor.
Figure 7B:
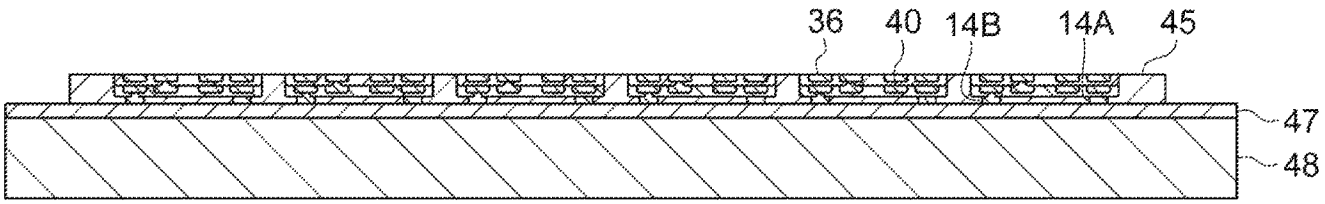

First, as illustrated in FIG. 7A, a groove 46 is formed in an outer circumferential portion of a laminate above a wafer 31 and a peelable copper foil is peeled from a release layer to peel the laminate from the wafer 31. Next, as illustrated in FIG. 7B, the laminate is adhered to another wafer 48 on which a release film 47 is laminated in an upside-down state, specifically, the laminate is adhered such that the lead-out conductors 14A and 14B face a lower side (the release film 47 side), and then the copper foil 34 of the top is removed.

Figure 7C:
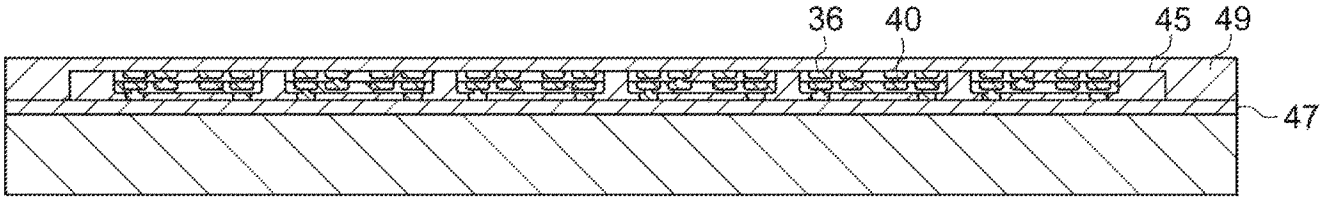
Figure 7D:
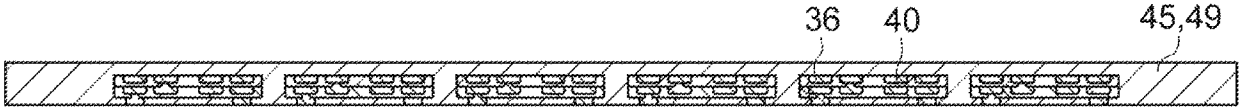
Figure 7E:
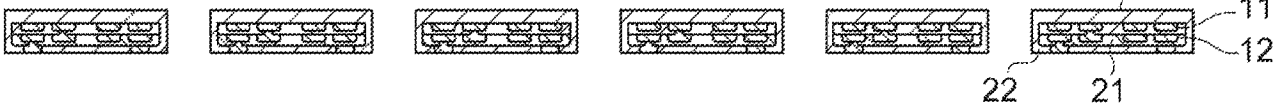

Subsequently, as illustrated in FIG. 7C, a fourth insulating material layer 49 is laminated by a magnetic mold using the insulating material used for the second insulating layer 22. Thereby, a lower surface of the first coil layer 11 (a surface opposite to the second coil layer 12 side) is covered by the insulating material used for the second insulating layer 22. Subsequently, as illustrated in FIG. 7D, after the wafer 48 is removed using the release film 47, the laminate is divided into individual pieces by dicing or the like. Thereby, as illustrated in FIG. 7E, a plurality of thin film inductors 1 acting as individual pieces can be obtained.

As described above, in the thin film inductor 1 according to the present embodiment, since the first insulating layer 21 which has a low Young's modulus covers the surroundings of the coil part 10, the first insulating layer 21 absorbs stress when any force is received from the outside so that the deformation of the coil part 10 can be prevented and a drop in characteristics of the inductor can be prevented. In addition, since the second insulating layer 22 is configured to cover the first insulating layer 21, rigidity for the entire thin film inductor 1 can be maintained, and this becomes a dominant configuration from the viewpoint of handleability.

In the second insulating layer 22, a composite material of a ceramic or a resin and a metal material is used as the main component. Thereby, the performance of the thin film inductor 1 can be improved while rigidity is enhanced.

As the metal material, nickel, iron, aluminum, or copper is used. Thereby, the thin film inductor 1 whose rigidity is further enhanced while a cost thereof is suppressed and characteristics there are maintained can be manufactured.

While embodiments of the present invention have been described, the present invention is not necessarily limited to the above embodiments and can be modified in various ways without departing from the spirit of the invention.

For example, in the thin film inductor 1 described in the embodiment, the example in which the terminal electrodes 15A and 15B are provided on the same main surface 1*a* has been described, but the arrangement of the terminal electrodes 15A and 15B can be appropriately changed. Shapes of the conductors of the coil part 10 are appropriately changed depending on the arrangement of the terminal electrodes 15A and 15B. That is, the winding direction of the coil, the position of the connector, the arrangement of the lead-out conductors, etc. are also appropriately changed.

In the thin film inductor 1 of the embodiment, the case in which the coil part 10 is formed of the two coil conductor layers (the first coil layer 11 and the second coil layer 12) has been described, but the coil conductor layers may be used as at least one layer. Since the first insulating layer 21 and the second insulating layer 22 assume the above configuration even if the coil conductor layers are used as one layer, a drop in characteristics as the thin film inductor can be prevented and rigidity can be enhanced.

In the thin film inductor 1 of the embodiment, the case in which only the main surface of one side of the first coil layer 11 is covered by the second insulating layer 22 rather than the first insulating layer 21 has been described, but the entire surface of the first coil layer 11 may be covered by the first insulating layer 21. A part of the first insulating layer 21 may be configured to be exposed to the outside.

What is claimed is:

1. A thin film inductor comprising:

a coil part formed of at least one coil conductor layer and having terminal electrodes provided at both ends thereof;

a first insulating layer configured to cover the coil part; and a second insulating layer configured to cover the first insulating layer and having a higher Young's modulus than the first insulating layer, the second insulating layer enclosing an entire outer surface of the first insulating layer, other than in a region of the first insulating layer covered by the terminal electrodes.

2. The thin film inductor according to claim 1, wherein the second insulating layer uses a composite material of a ceramic or a resin and a metal material as a main component.

3. The thin film inductor according to claim 2, wherein the metal material is nickel, iron, aluminum, or copper.

* * * * *